US005095733A

United States Patent [19]

Porucznik et al.

[11] Patent Number: 5,095,733

[45] Date of Patent: Mar. 17, 1992

[54] MAINTAINING A PREFERRED VIBRATION MODE IN AN ANNULAR ARTICLE

[75] Inventors: Paul Porucznik, Oxford, England; Christopher F. Cheers, Swindon, United Kingdom

[73] Assignee: CMB Foodcan plc, England

[21] Appl. No.: 501,985

[22] Filed: Mar. 28, 1990

[30] Foreign Application Priority Data

Mar. 28, 1989 [GB] United Kingdom ..... 8906998

[51] Int. Cl.[5] ..... B21D 41/04

[52] U.S. Cl. ..... 72/467; 72/710; 72/347

[58] Field of Search ..... 72/467, 710, 56, 285, 72/347, 349

[56] References Cited

U.S. PATENT DOCUMENTS 3,243,989 4/1966 Meats ..... 72/467

3,910,085 10/1975 Biddell ..... 72/467

FOREIGN PATENT DOCUMENTS 297754 1/1989 European Pat. Off. .

*Primary Examiner*—Daniel C. Crane

*Attorney, Agent, or Firm*—Diller, Ramik & Wight

[57] ABSTRACT

A forming die of a kind having a top surface (38) a bottom surface, a peripheral side surface (39) connecting the bottom surface to the top surface (38) and including a receptor area (36) for receiving vibratory force, and an annular work surface (32) defining an aperture extending from said top surface through to said bottom surface has a plurality of localised mass concentrations 43,44,45, arranged symmetrically about an axial plane normal to the plane of the receptor area. The shape of the die is designed to modify resonant frequencies corresponding to unwanted modes of vibration to increase the separation between the frequencies of the unwanted modes and a chosen R0 mode of vibration. The die may be adapted for use in the operations of reducing the diameter of a tubular article; deep drawing or like processes.

14 Claims, 13 Drawing Sheets

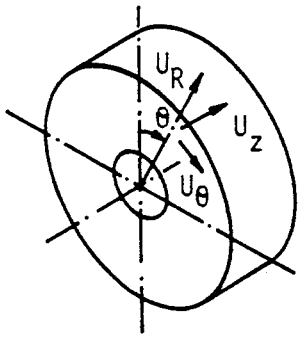
FIG. 3
FIG. 3a
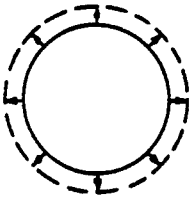
FIG. 3b
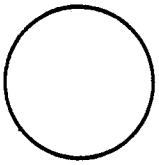
FIG. 3c
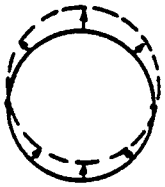
FIG. 3d
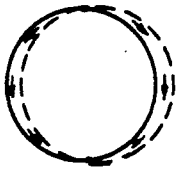
FIG. 3e
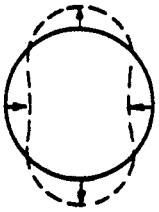
FIG. 3f
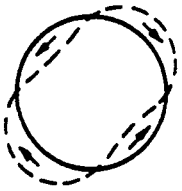
FIG. 3g
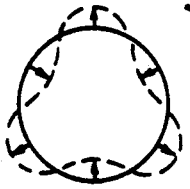
FIG. 3h
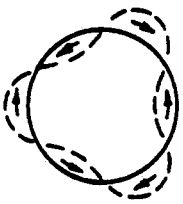

FIG. 5 ℓ

30°
R0
R1
R3
19
20
21
22
23
24
25
26
kHz

30°
60°
R0
R1
R3
19
20
21
22
23
24
25
26
kHz

60°
R0
R1
R3
19°
20
21
22
23
24
25
26
kHz

MAINTAINING A PREFERRED VIBRATION MODE IN AN ANNULAR ARTICLE

This invention relates to annular articles excited to vibrate at a chosen frequency in a chosen mode and supression of undesired modes, and more particularly but not exclusively to control of vibration mode in annular dies forced to vibrate at ultrasonic frequency during the formation of a neck of reduced diameter and shoulder on a tubular body such as a can body, and may find application in a similar process such as the deep drawing of sheet materials, and drawing of tubes.

Our British Patent Application, published No. 2206304A describes apparatus comprising a central mandrel having a profiled surface defining the interior of a shoulder and neck on a welded can body, a circular die having an annular work surface, complimentary to that of the mandrel, to define the exterior of the shoulder and neck of the can body. A transducer, coupled to a small flat surface of the die periphery, forces the die to vibrate at a frequency of about 20 KHz in a radial mode so that, as the can body is pushed, by a lifter plate to pass in between the die and mandrel surfaces, frictional forces are cyclically abated and much greater reductions in can diameter can be achieved than would be possible without ultrasonic vibration. Annular articles can vibrate in many modes as is discussed in "Mechanical Vibrations" by J P Den Hartog Page 165A. The greater amplitude of vibration may be axial or radial, or torsional; the number of nodes may alter, for example, from two to four or six. In this description a radial mode suitable for reduction of the diameter of tubular articles will be described fully but it will be understood that the principles taught have wider application.

In the process of necking-in cans we find that a uniform radial mode of vibration at 20 KHz is advantageous because it gives rise to maximum amplitude of die displacement at the work surface of the die. However, if other natural modes of vibration occur at frequencies close to our preferred frequency of about 20 KHz in the radial mode of vibration there is a risk that the die will switch, during use, to a less advantageous mode of vibration as work done on the can body damps the desired vibration.

In a first aspect this invention provides a forming die of a kind having a top surface; a bottom surface, a peripheral side surface connecting the bottom surface to the top surface and including a receptor area for receiving vibratory force, and an annular work surface defining an aperture extending from said top surface through to said bottom surface characterised in that a plurality of localised mass concentrations arranged symmetrically about an axial plane normal to the plane of the receptor area modify certain resonant frequencies corresponding to unwanted modes of vibration and so increase the separation between the said resonant frequencies of unwanted modes and the resonant frequency of the chosen R0 mode of vibration (as hereinbefore defined).

In one embodiment the work surface of the die comprises an annular shoulder forming profile axially aligned with a cylindrical neck forming profile so that the die may be used to reduce the diameter of a tubular article and create for example a shoulder and neck at one end of a can body.

The forming die may comprise a die member of wear-resistant material surrounded by a die holder having the localised concentrations of mass at its periphery.

The die member may be made of tool steels, titanium carbide dispersed in a metal matrix, or a material sold under the trademark "SYALON 101" by Lucas Cookson.

The die holder may be made of a material of low damping capacity such as aluminium, aluminium alloy, titanium or titanium alloy.

The plurality of localised concentrations of mass can be created by adding or removing mass to a one piece die or to a die holder. In several of the embodiments described below, the localised concentrations of mass are bounded by arcuate surfaces each connected to the next by cordal flat surfaces. The receptor area may be in one of the cordal flat surfaces or alternatively one of the arcuate surfaces, although the vibration frequencies arising in use will differ in each case.

Alternatively, the areas of localised mass concentration may be separated by recesses in the top or bottom surface of the die or die holder.

The receptor area may comprise a small flat surface to receive vibratory energy, surrounding a threaded socket to receive a threaded member of a transducer.

In a second aspect this invention provides a method of forming a die adapted to vibrate in a chosen mode (RO) when forced to vibrate by means of vibratory force operating at a predetermined frequency, comprising the steps of:

a) providing a generally cylindrical die dimensioned to bring the frequency of vibration of the die in the chosen mode close to the predetermined frequency;

b) calculating the frequency of vibration of the die in undesirable modes of vibration; and c) altering the frequency of vibrations of the die in one or more of the undesirable modes of vibration to increase the difference in frequency between the undesirable mode or modes and the chosen mode (RO), by machining away material from at least two selected areas of the die to leave localised concentrations of mass between the machined areas.

It is generally impractical to create the localised concentrations of mass by adding mass at required locations because the attachments will be liable to fracture or absorb vibration energy. The preferred method is to modify the shape of the die to achieve the required mass concentrations. According to one embodiment of the method in step (a) a die blank is provided having excess material around its peripheral surface and in step (c) the localised concentrations of mass are created by cutting away some of the excess peripheral material. For example, the localised concentrations of mass may be created by machining a plurality of flat surfaces into the excess peripheral material so that peripheral material between the flats becomes localised concentrations of mass.

In another embodiment of the method material of the die blank is locally removed from the top surface or bottom surface or both, to create recesses which decrease the stiffness of cross-section and localised concentrations of mass therebetween.

In a preferred method, the die blank provided in step (a) comprises a die member of wear-resistant material surrounded by a die holder which is fixed to the die member by means of brazing or a heavy interference fit so that in step (b) the die member and die holder are treated as a whole for analysis and in step (c) the localised concentrations of mass are created in the die holder.

Various embodiments will now be described by way of example and with reference to the accompanying drawings in which:

FIG. 3 is a perspective sketch of a cylindrical die;

Figure 2:
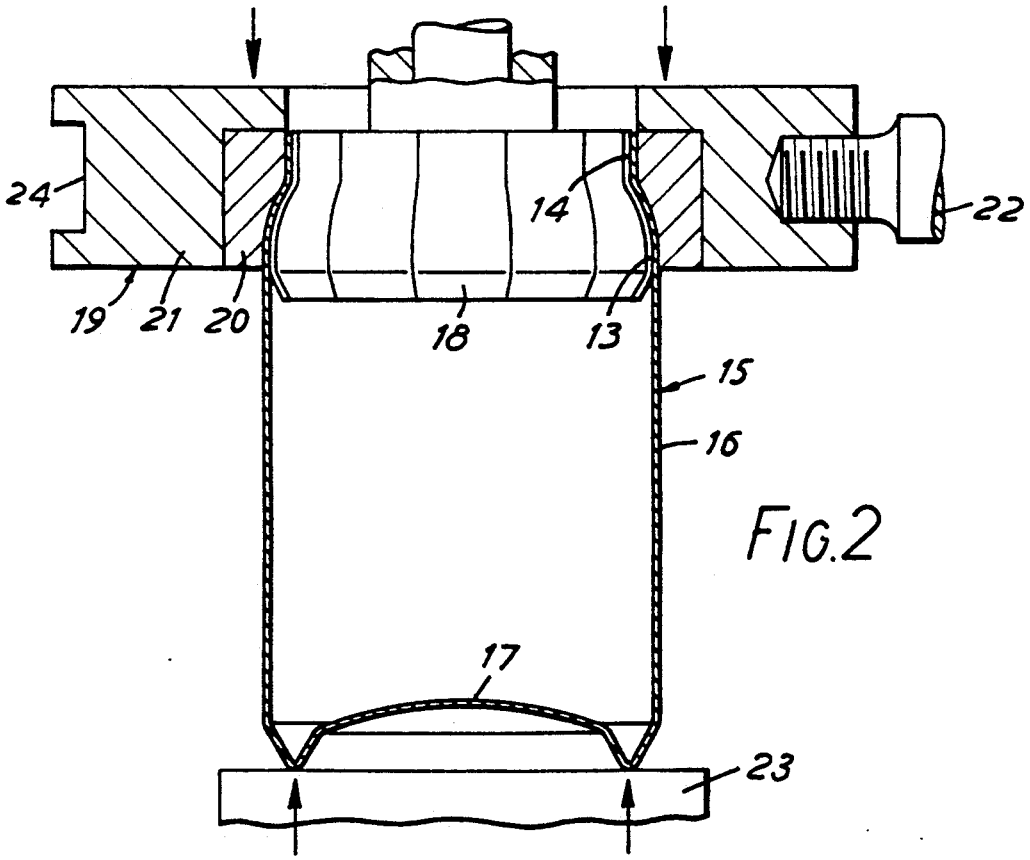
FIG. 2 is a sectioned side view of a collapsible mandrel and an ultrasonically assisted die, according to this invention, as used for reducing the mouth of a can body 65 mm diameter closed at one end.
Figure 4A:
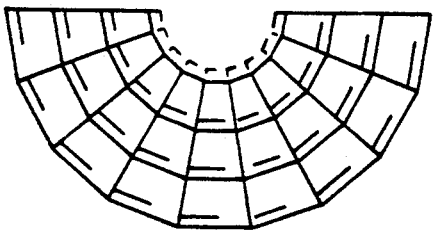
Figure 4C:
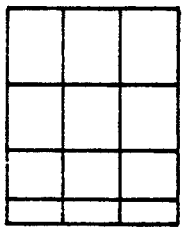
Figure 4B:
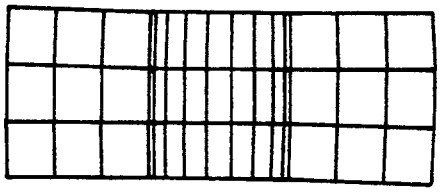
Figure 4D:
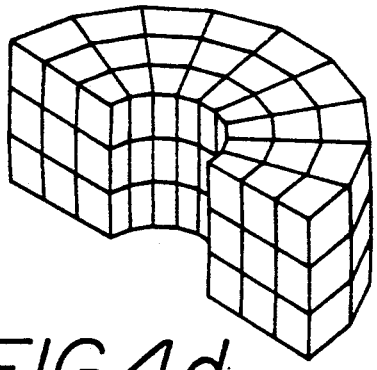
Figure 4E:
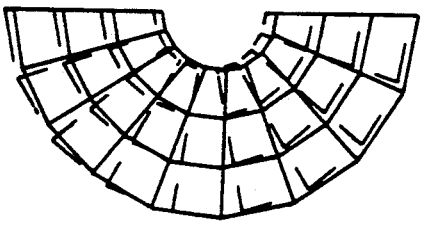
Figure 4G:
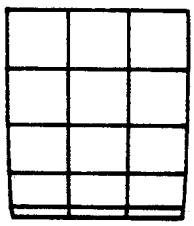
Figure 4F:
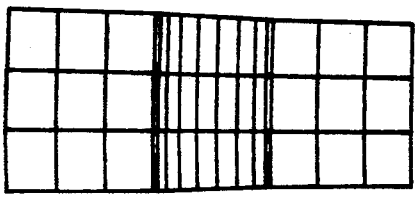
Figure 4H:
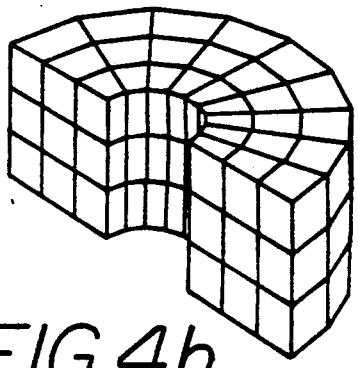
Figure 4I:
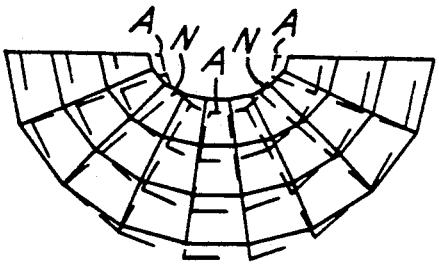
Figure 4K:
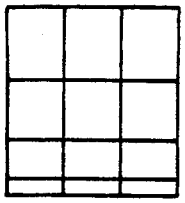
Figure 4J:
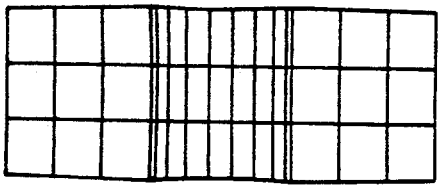
Figure 4L:
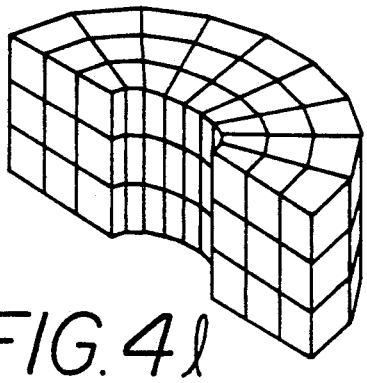
Figure 4M:
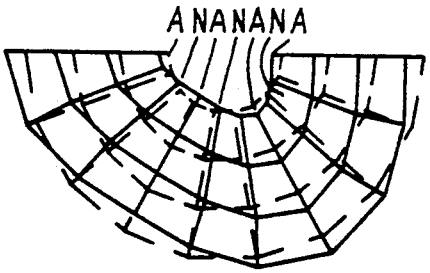
Figure 4O:
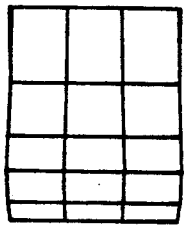
Figure 4N:
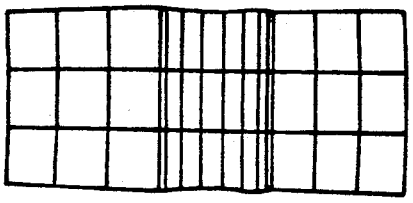
Figure 4P:
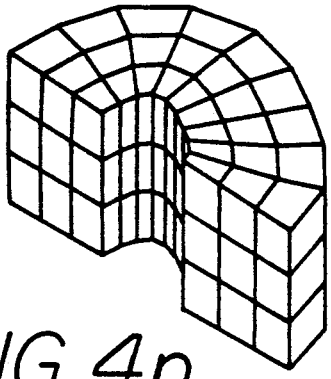
Figure 5A:
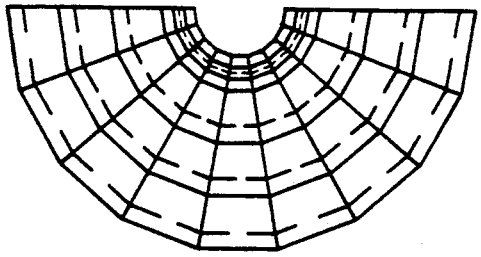
Figure 5C:
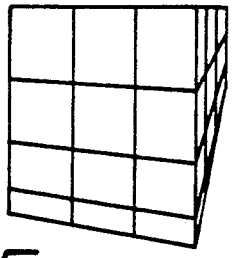
Figure 5B:
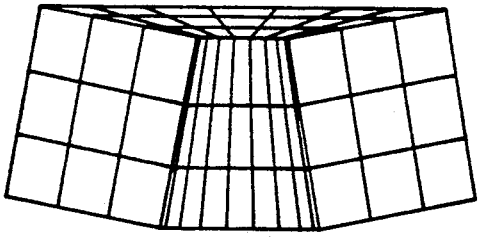
Figure 5D:
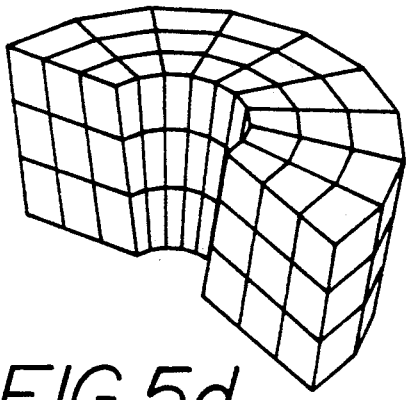
Figure 5E:
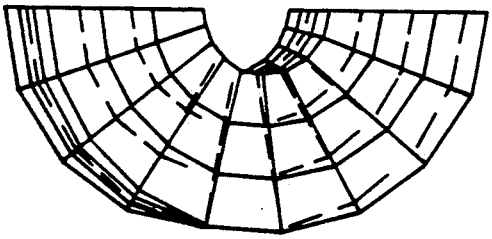
Figure 5G:
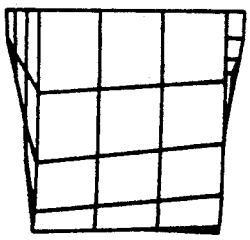
Figure 5F:
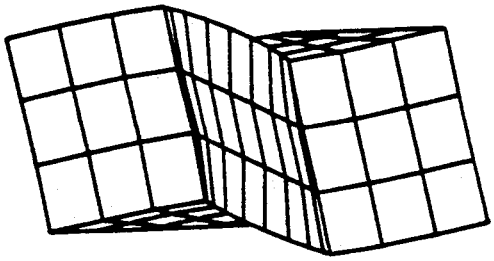
Figure 5H:
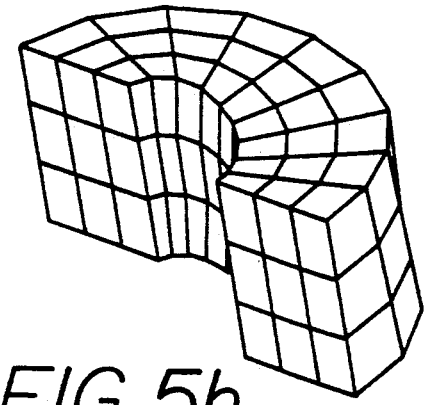
Figure 5I:
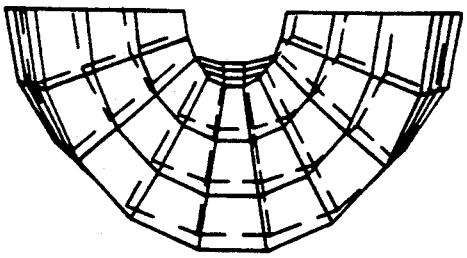
Figure 5K:
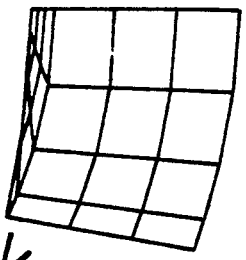
Figure 5J:
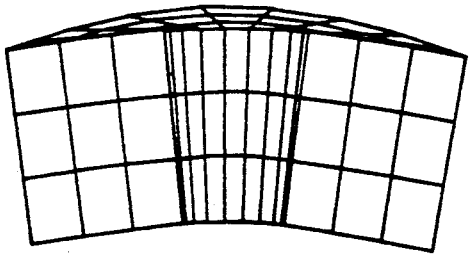
Figure 5M:
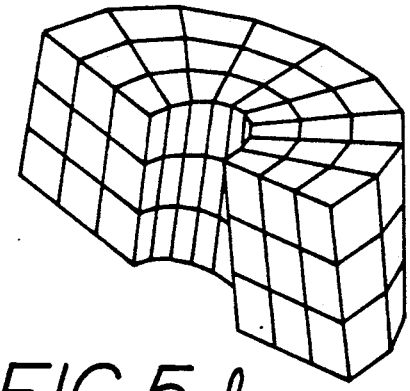
Figure 5M:
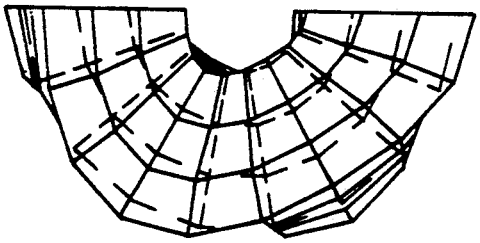
Figure 5O:
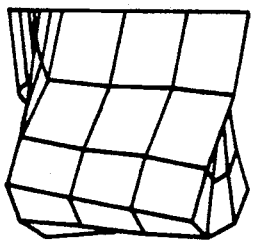
Figure 5N:
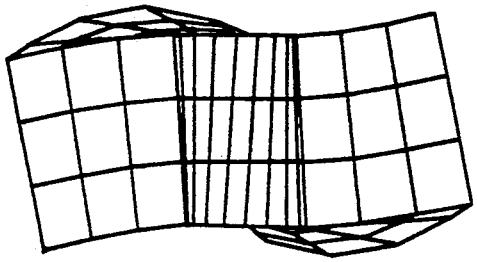
Figure 5P:
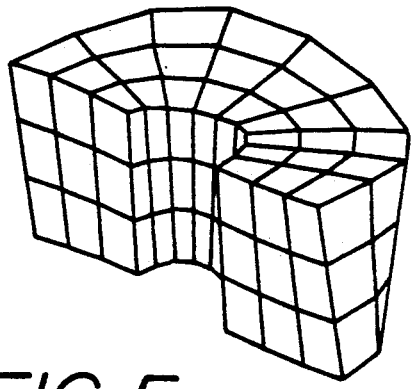
Figure 6A:
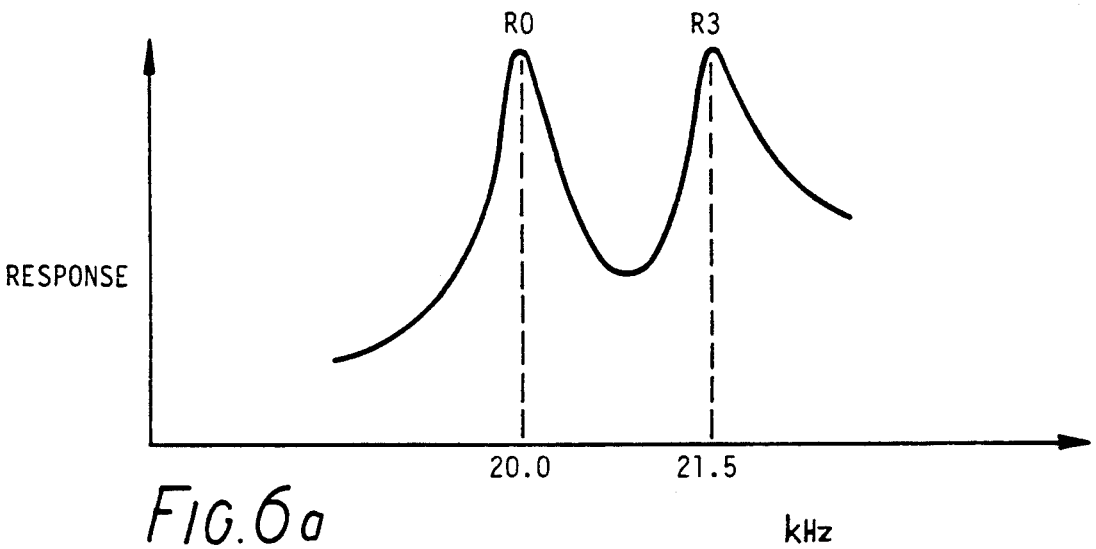
Figure 6B:
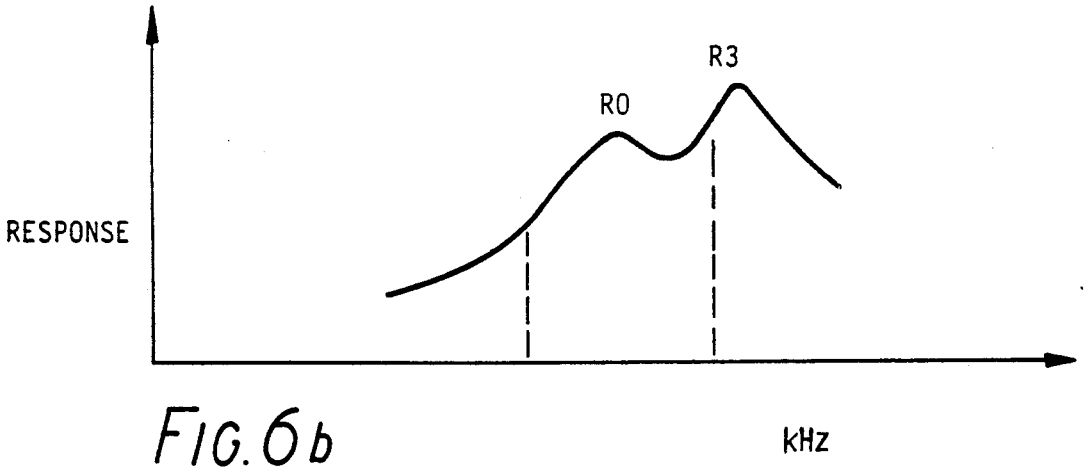
Figure 6C:
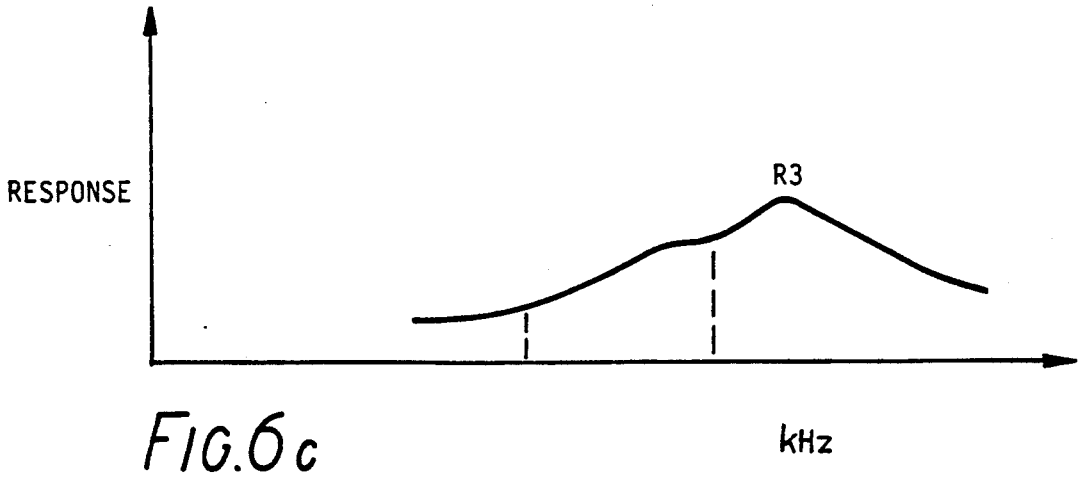
Figure 7C:
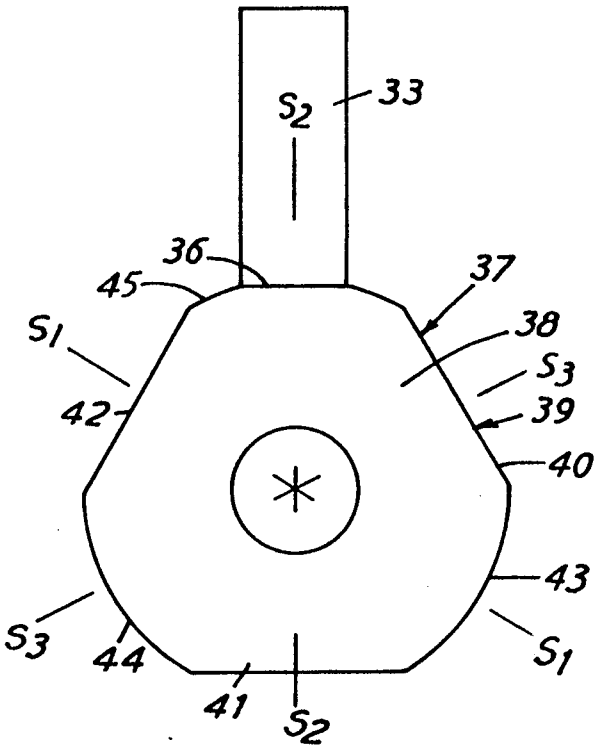
Figure 7B:
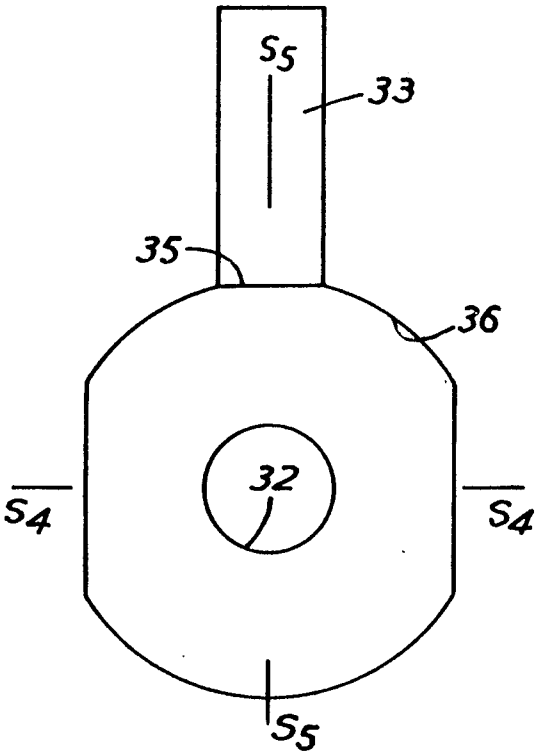
Figure 7A:
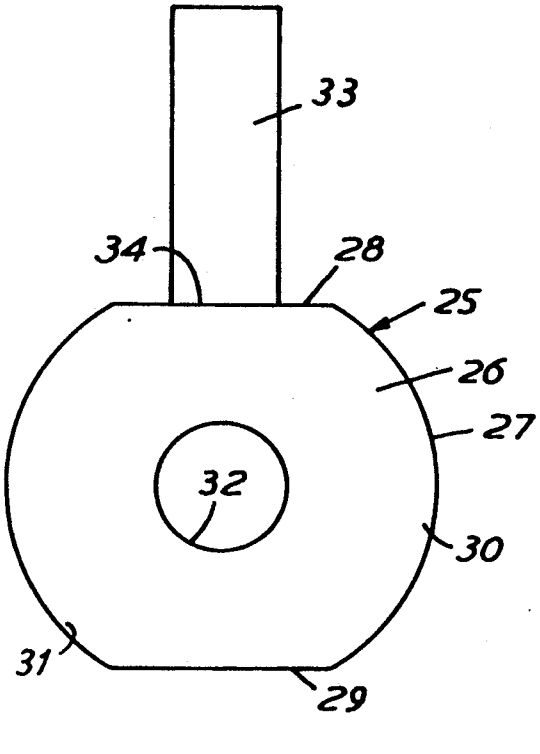
Figures 8A, 8B, 8C:
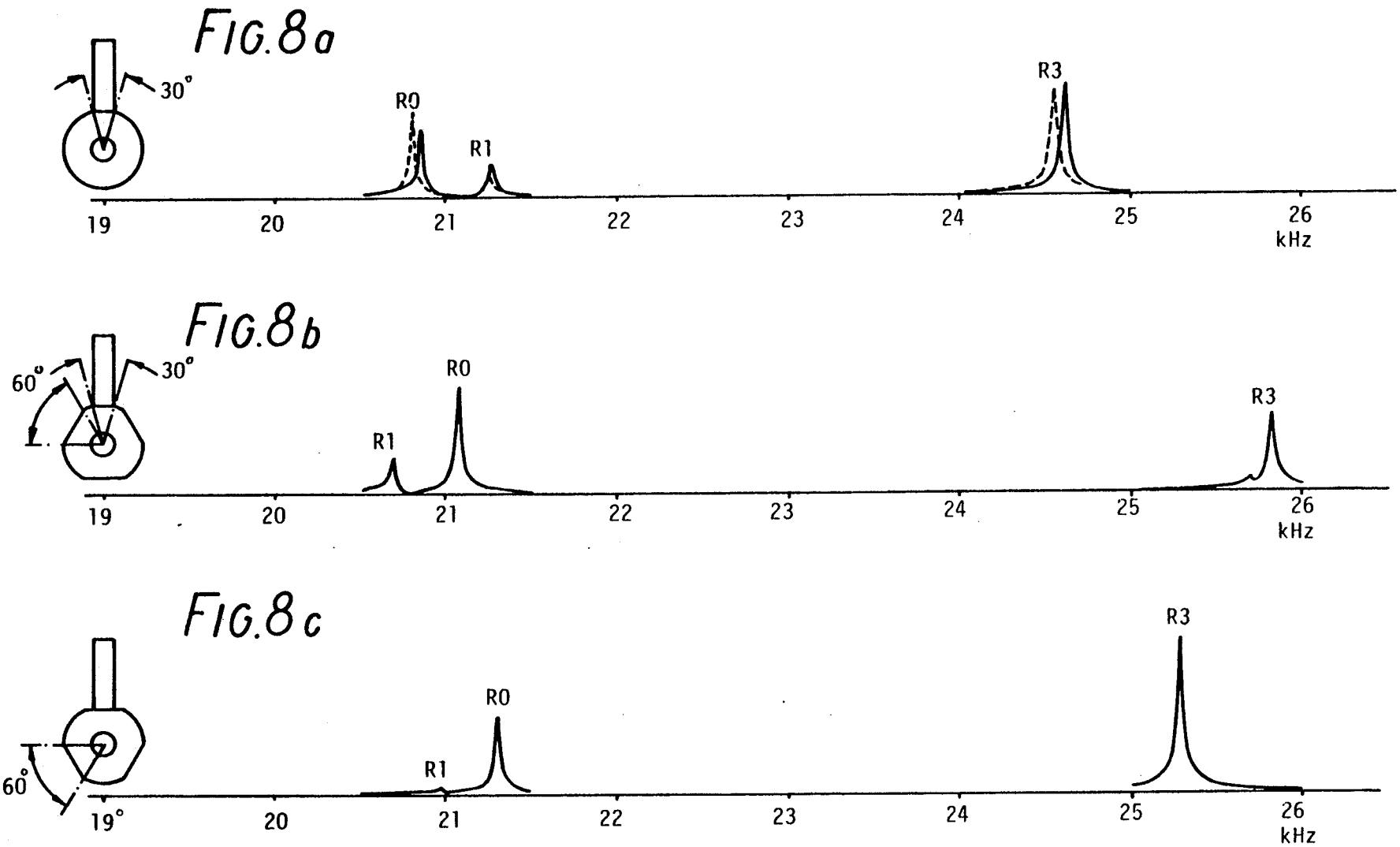
Figure 8D:
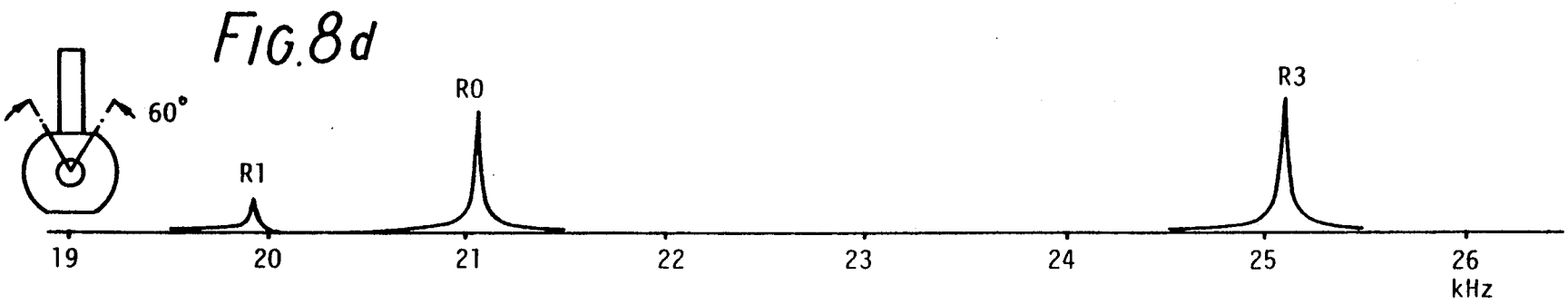
Figure 8E:
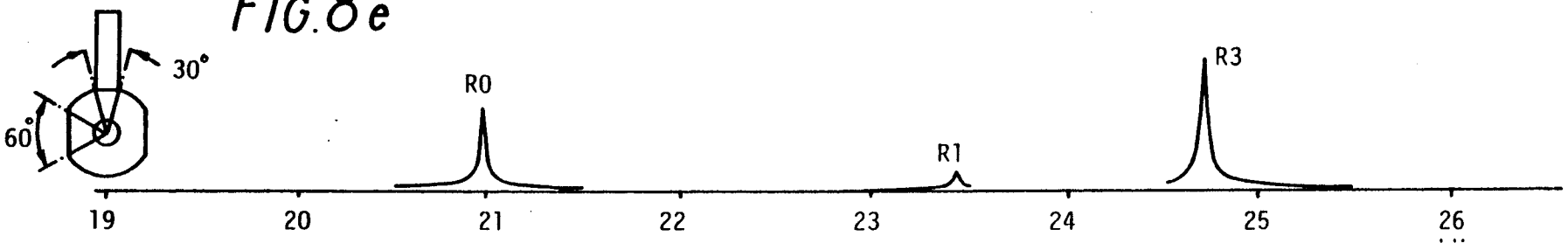
Figure 9A:
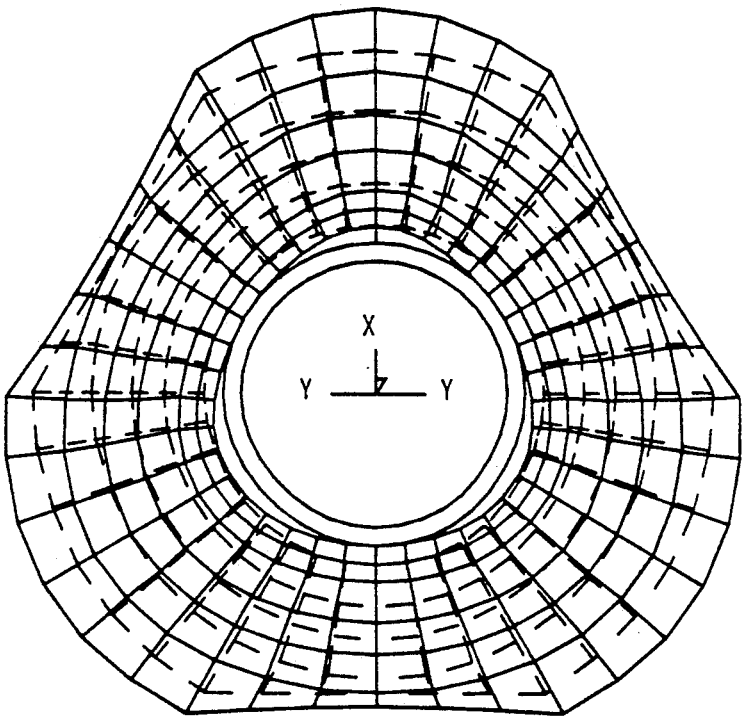
Figure 9B:
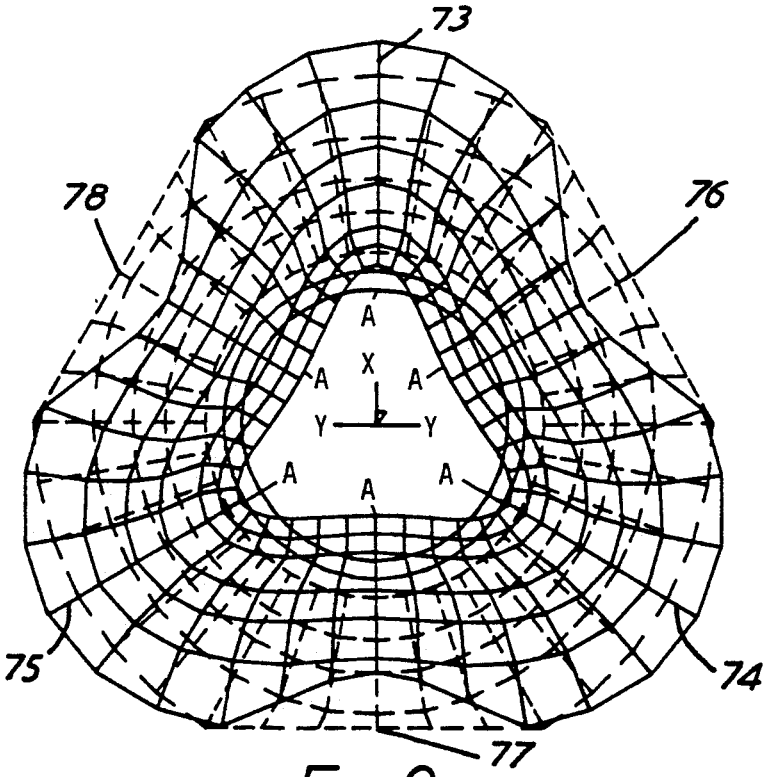
Figure 10A:
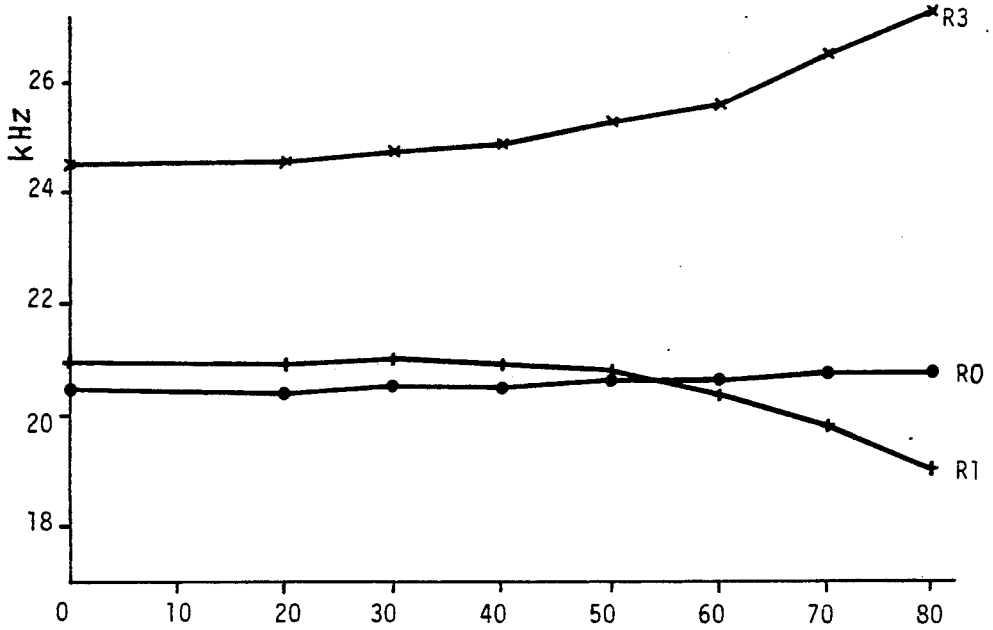
Figure 10B:
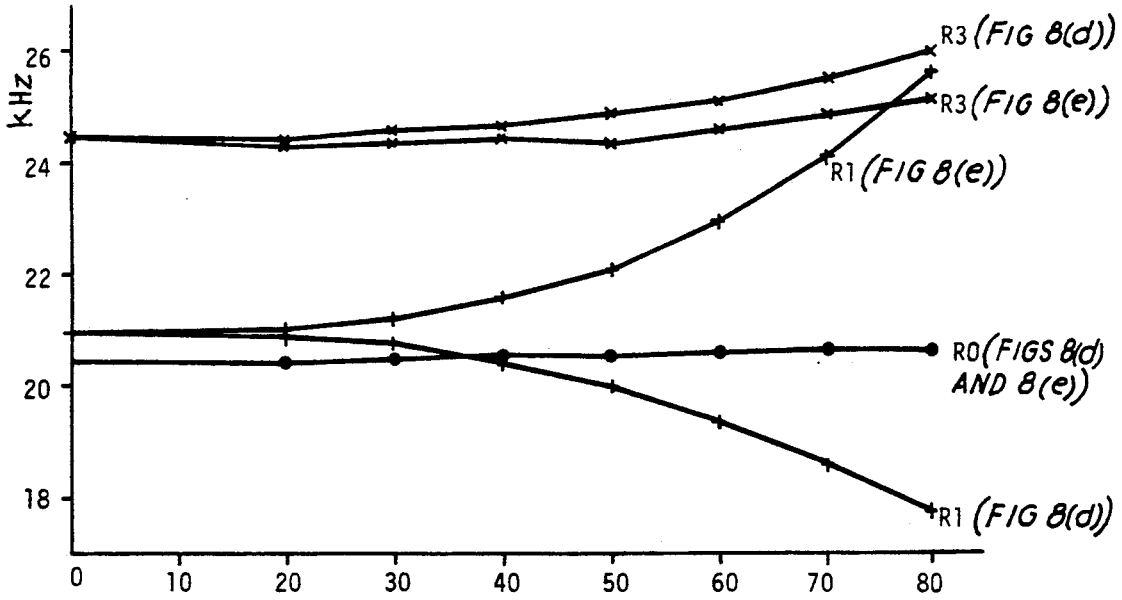
Figure 11B:
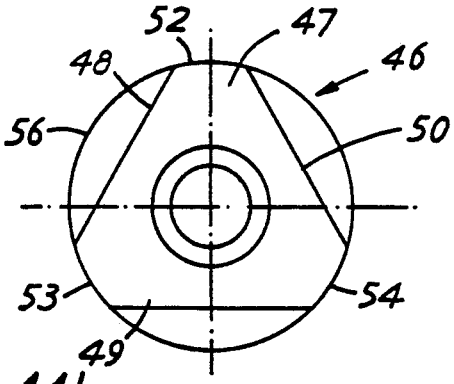
Figure 11A:
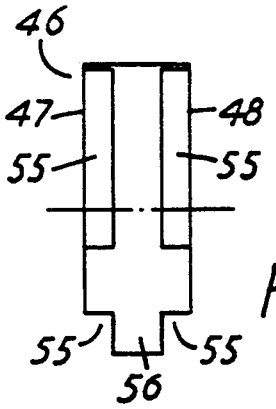

FIGS. 3*a* through 3*h* show diagrammatically radial, axial, and tangential displacements available to the round die of FIG. 2;

FIGS. 4*a* through 4*p* depict as computer printouts, various radial "R" modes of vibration predicted by finite element analysis of the die behaviour;

FIGS. 5*a* through 5*p* depict various torsional "T" modes predicted by finite element analysis;

FIGS. 6 (*a*),(*b*) and (*c*) are simplified graphs of response (displacement) v frequency in a chosen direction arising in a die driven to vibrate in (a) the unloaded condition; (b) the loaded condition, and (c) the heavily loaded condition—respectively;

FIGS. 7 (*a*),(*b*), and (*c*) show three modified shapes of die bolster that change the resonant frequencies in the non-preferred modes of vibration in relation to those of an annular die. This can help to sustain a particular frequency of vibration in a chosen mode;

FIGS. 8 (*a*),(*b*),(*c*),(*d*) and (*e*) show graphically for comparison, predicted frequency/response spectra for dies having a small receptor surface and zero, two or three chordal flat surfaces;

FIGS. 9 (*a*) and (*b*) compares the R0 and R3 mode shapes arising in a die having three chordal flat surfaces as predicted by finite element analysis;

FIGS. 10(*a*) and 10(*b*) are graphd of frequency v size of flat surface arising from finite element analysis on a steel die; and FIGS. 11*a*, 11*b*; 11*c*, 11*d*; 11*e*, 11*f*; and 11*g*, 11*h* show alternate shapes of die having localised concentrations of mass/stiffness around their periphery.

Figure 1:
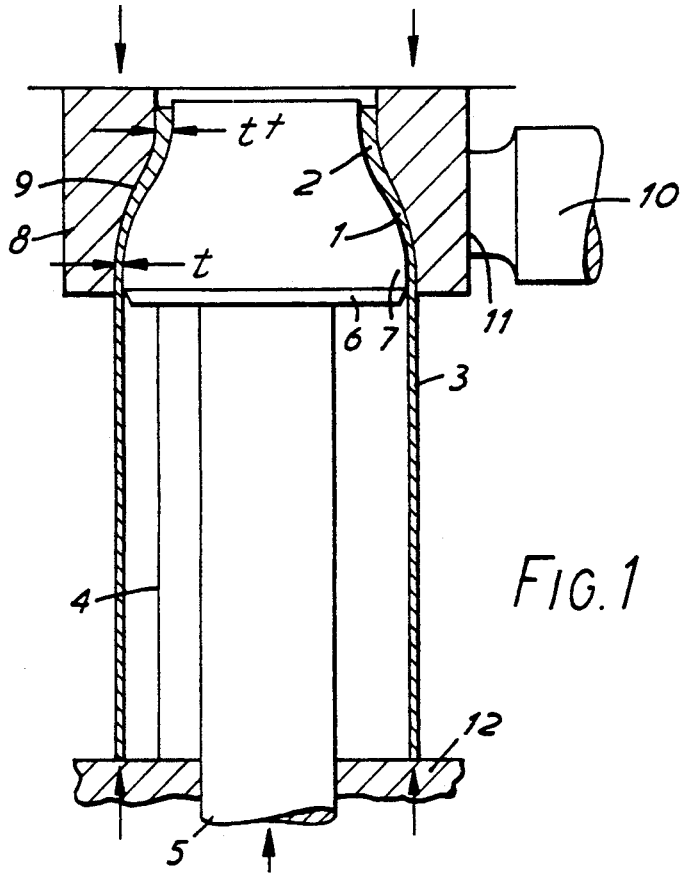
FIG. 1 is a sectioned side view of a mandrel and ultrasonically excited round die for reducing the mouth of a container body 45 mm diameter as is fully described in our copending British Patent Application published No 2206304A.

FIG. 1 shows prior art apparatus for producing a shoulder 1 and neck 2 of reduced diameter on an aerosol can body 3 of 45 mm diameter having a welded side seam 4. The apparatus comprises a mandrel 5 having a plug portion 6 provided with a work surface 7 to define the internal profile of the shoulder 1 and neck 2; an annular die 8 having a bore centred on the axis of the die defining a work surface to define the exterior of the shoulder and neck; a transducer 10 coupled to a small flat receptor surface portion 11 of the periphery of the die; and a lifter pad to urge the tubular body in between the plug portion 6 of the mandrel and the work surface 9 of the die. During use of this apparatus we have observed that the preferred radial mode of vibration of the die at about 20 KHz, excited by the transducer 10, can switch to an alternative mode giving less amplitude of vibration at the work surfaces (7,9) of plug and die so that frictional forces rise to prevent complete forming of the shoulder or neck and the can body is spoiled. This apparatus is fully discussed in our co-pending British Patent Application No. 2206304A to which the reader is directed for further information.

FIG. 2 shows apparatus, according to this invention for producing a shoulder 13 and neck 14 of reduced diameter on a can body 15 drawn from sheet metal such as tinplate or aluminium alloy to comprise a cylindrical side wall 16 of 211 diameter (65 mm approx) closed at one end by a domed bottom wall 17. This shape of can body is used to contain beer or other beverages. The apparatus comprises a collapsible mandrel 18 to define the interior shape of a shoulder 13 and neck 14, an annular die 19 surrounding the mandrel and comprising a die member 20 surrounded by a die holder 21, a transducer 22 for exciting the die 19 to vibrate in a preferred radial mode; and a lifter pad 23 to urge a terminal portion of the side wall to pass between the mandrel 18 and die member 20. The die holder 21 is round and has a flat chordal surface cut into the peripheral wall opposite the transducer receptor surface. The preferred mode of vibration for these dies provides a uniform radial motion on the inside (working) surface. The geometry of the die is designed to be such that the resonant frequency of the die in this mode matches that of the proprietary ultrasonic vibration generators—generally 20,000 cycles per second (20 kHz). Higher frequency equipment is available (e.g., at 22, 30, 35 and 40 kHz), but at higher frequency it is necessary to reduce the working amplitude to prevent an increase in the material stress which could be damaging. Therefore, to achieve maximum amplitude on the working surface the lowest available frequency is preferred. Frequencies lower than 20 kHz are not generally available because they are more audible to the human ear.

Finite element analysis has been used to assist in the design of these dies. The dies are substantially short thick-walled cylinders with a form on the inside surface suitable for the application. A small flat receptor area is machined on the outside surface to which the proprietary ultrasonic power transducer is fitted. The width of the flat is essentially equal to the diameter of the transducer, and the arcuate volume of material removed in machining the receptor flat is very small compared to the total volume of the die. Typically the receptor flat subtends about 30° at the central axis of the die. This flat has been found to have negligible effect on the vibration characteristics of the die. Indeed, most finite element analysis has been done using axisymmetric models, which assume a fully cylindrical die, because these have been found to give the most accurate results.

FIG. 3 serves to show diagrammatically four modes of radial vibration of particular relevance to dies used for reducing the diameter of tubular articles. The perspective sketch shows $U_R$=Radial displacement; $U_\theta$=-Tangential displacement; and $U_Z$=Axial displacement. Beneath the perspective sketch the relationship between harmonic number, and the three displacements ($U_R$; $U_\theta$; $U_z$) is shown in tabular form against each of four modes.

FIGS. 3*a* and 3*b* show that when the harmonic number "n" is O,$U_R$ and $U_z$ vary according to cos $n\theta=1$ and $U_\theta$varies as sin n $\theta$=O giving rise to a vibration centred on the axis of the circular die. The practical result is a die which, in use, expands and contracts in a radial direction while contracting and expanding in thickness axially to a lesser extent with each vibration cycle.

FIGS. 3*c* and 3*d* depict diagrammatically the displacements arising when the harmonic number "n"=1. Again $U_R$ and $U_Z$ vary as cos $n\theta$, $\theta$ being the angular position on the die referred to the point of excitation so that in practice a die vibrating in this harmonic mode vibrates laterally in the radial direction and provides little relief of friction on a diameter of the work surface defined by the die. It will be noticed that the $U_\theta$ displacement is tangential so failing to provide complete relief of friction, so vibrations of harmonic number 1 are not desirable for our purpose.

FIGS. 3*e* and 3*f* depict diagrammatically the displacements arising when the harmonic number "n"=2. Whilst this mode of vibration provides cycle grip and relief on a diameter in the radial direction, four nodes arise to lessen the usefulness: The displacement gives rise to tangential motion $U_\theta$ that does not assist a workpiece entering the die.

FIGS. 3*g* and 3*h* depict diagrammatically the motions arising when the harmonic number "n"=3. The displacements $U_R$ and $U_z$ give rise to a mode of vibration having three nodes that prevent relief of frictional force on a work piece entering the die. Furthermore the displacement gives rise to a tangential motion $U_\theta$ that does not assist a work Piece entering the die.

In this specification "R" is used to denote modes which involve essentially radial displacement of the die cross section and "T" denotes modes which involve "twisting" or essentially rotation of a die section, "n" denotes harmonic number as described by reference to FIGS. 3(*a*),(*b*),(*c*) and (*d*). Amplitude variations (displacements) are derived as discussed with reference to FIG. 3 in which $\theta°$ is an angular position on the die so $U_\theta = \sin n\theta$ as already discussed.

One special case also exists where n=0, $U_R = U_Z = 0, U_\theta$ is constant around the die (for varying $\theta$). This describes "shaft torsion" modes which are generally not useful for ultrasonic dies.

The concept of harmonic number (mode number) is recognised in several computer programmes for finite element analysis, e.g. "ANSYS" trade mark of Swanson Analysis Systems Inc, P.O. Box 65, Houston, Pa., and "PAFEC" trademark of Pafec Ltd, Strelley Hall, Strelley, Nottinghamshire, NG8 6PE, which have been used for design of dies.

In FIGS. 4*a*–4*d*; 4*e*–4*h*; 4*i*–4*l*; and 4*m*–4*p* radial modes of vibration of a short cylindrical steel die are depicted as computer printouts achieved by use of the "ANSYS" program. In FIGS. 4*a*–4*d* the die shapes arising in R0 mode are shown as:

FIG. 4*a* is a plan view of half the die, in which it can be seen that the displacement is radial as shown by comparing the dashed lines denoting the original shape with hard lines of exaggerated displaced position;

FIG. 4*b* is a sectioned side view (first angle projection) in which some contraction of the die thickness is seen to be accompanied by some barrelling of the peripheral surface;

FIG. 4*c* is a first angle projected end view of half the die which shows that no torsional displacement arises;

FiG. 4*d* is a perspective view of half the die showing clearly "brick" elements available for finite element analysis. These printouts confirm the displacements discussed with reference to FIG. 3.

FIG. 4*e* shows the die shapes arising when a die vibrates in an R1 mode. The plan view clearly shows, by coincidence of the original work surface (dashed lines) with the displaced work surface (hard lines) that two nodes develop on a diameter. The distorted work surface can be seen in the side views and perspective view. The sectioned side view (FIG. 4*f*) shows that the cyclic radial contraction of the work surface at one side of the die is accompanied by an increase in axial thickness of the die. FIG. 4*g* shows this swelling at one antinodal area and a similar reduction in thickness on the opposite side of the die.

Therefore, much of the vibration energy is spent in tangential and axial motion of the die material and the nodes arising at the work surface give little relief of friction on a work piece in the die.

FIGS. 4*i*–4*l* show the die shapes arising when a die vibrates in an R2 mode. The half plan view FIG. 4*i* shows the development of two nodes N (four in the whole die) and three antinodes A (four in total) as can be seen by comparison of the original shape (dashed lines) and displaced shape (hard lines). FIG. 4*j* shows that, at one pair of antinodes the die is contracted in thickness at the periphery and locally thickened at the work surface, but this movement is reversed for the other pair of antinodes on a diameter at right angles to the first pair of antinodes. FIG. 4*k*, the projected view shows relative absence of torsional motion. The perspective view, FIG. 4*l*, confirms the displacements shown in FIGS. 4*i*–4*k*. Much of the vibration energy of this R2 mode is spent in movement of die material that does not relieve friction on a work piece in the work surface of the die FIGS. 4*m*–4*p* show the die shapes arising when a die vibrates in the R3 mode. The half plan view (FIG. 4*m* again shows original shape in dashed lines and displaced shape in hard lines, so that three of the six nodes N and four of the antinodes A are visible and confirm the six node/six antinode mode Predicted by consideration of FIGS. 3*g* and 3*h*. The complex wave forms arising across the die can be seen by comparing FIGS. 4*n* and 4*o* which show material motion during the vibration cycle to cause distortion of the work surface in both axial and radial directions. FIG. 4*p* the perspective view confirms the displacements shown in FIGS. 4*m*–4*o*.

The average radial amplitude on the work surface when the die is vibrating in this mode is considerably less (for a given amplitude at the receptor surface) than would be achieved with the die vibrating in the R0 mode. Furthermore, there are 6 lines along the work surface where the radial amplitude is zero. Similar limited displacement arises in the R1 and R2 modes.

FIGS. 5*a*–5*d*; 5*e*–5*h*; 5*i*–5*l*; and 5*m*–5*p* show the changes in shape that arise in twisting modes denoted TO, T1, T2, T3. Brief study of these pictures, which are presented in like manner to radial modes discussed fully with reference to FIGS. 4*a*–4*p* shows that all these twisting modes fail to provide the work surface shapes that we find useful for (a) die necking to create a shoulder and neck on a tubular article, (b) deep drawing of a can body from a sheet or cupped preform; or (c) drawing of a wire, tube or rod to a reduced diameter.

Under the above system of nomenclature the preferred mode of vibration is called R0. Other modes which have been predicted at resonant frequencies close to 20 kHz and verified on real dies are R1 and R3. Tx modes (x=0–4) have also been predicted at similar frequencies but are not usually found in practice because the mode shape is not easily driven by the transducer.

These alternative (or harmonic) modes can reduce the effectiveness of an ultrasonic die if any other resonant frequency appears close to the 20 kHz working frequency in the R0 mode. The reason for this is connected with the frequency spectrum of the die-transducer assembly and with the control systems built into the ultrasonic generator.

The proprietary equipment used to drive ultrasonic dies generally consists of an electrical frequency generator (converts 240 V 50 Hz to variable voltage, variable current, approximately 20 kHz) and a power transducer (converts the 20 kHz electrical power to mechanical vibrations). The generator includes several control circuits which automatically adjust voltage, current and frequency. These adjustments are essential to maintain a constant vibration amplitude under conditions of varying load, and to maintain the mechanical system at resonance while its resonant frequency varies. The frequency variation may be caused by changes in temperature and/or loading conditions and will often be very small (of the order 400 Hz—or 2 per cent). Nevertheless, it is necessary for the generator to follow this variation because the resonance peak is very sharp and efficiency would otherwise be greatly reduced.

FIGS. 6(*a*)(*b*) and (*c*) show diagrammatically instrument response (proportional to amplitude of vibration in the chosen test direction) v frequency of vibration in kHz as may arise using a round die.

FIG. 6(*a*) shows a simplified frequency response spectrum for an ultrasonic die with an unwanted R3 frequency. It shows two peaks—one at 20.0 kHz for the preferred R0 mode and one at 21.5 kHz for the R3 mode. The peaks are sharp (indicating low damping) and discrete.

FIG. 6(*b*) shows how this spectrum might change when the die is loaded, e.g. when a solid plug and a thin walled can are pushed into the centre. The effect on the R0 resonance peak is substantial, because this mode applies a large amplitude to the workpiece and is correspondingly strongly affected by the mass, stiffness and damping properties of the workpiece and plug. The effect on the resonance peak is to lower its height (because of extra damping) and raise its frequency (because of extra stiffness). Loading the die will cause a similar modification of the R3 resonance peak, but the effect is much less. This is because the amplitude on the inside die surface in the R3 mode is much smaller than for the R0 mode. Furthermore, the amplitude varies around the circumference, with a mean value zero. Therefore, the mass, stiffness and damping of the workpiece and plug have much less effect on the R3 resonance peak than on the R0 peak.

FIG. 6(*c*) shows this effect on the frequency spectrum exaggerated still further—as it might be under very heavy loading. The R0 resonance peak has effectively disappeared.

Consider the effect of this changing frequency spectrum on the automatic frequency control (afc) system of an ultrasonic generator. This is designed to maintain resonance in the vibrating parts by adjusting the operating frequency. Its operation is complicated and varies from one generator to another, but to simplify the explanation let us assume that it operates by searching for a peak in the frequency spectrum. Naturally, the generator has no information about the mode in which the die is vibrating, but a starting point for the frequency search can be controlled by the operator. The afc system should maintain the R0 resonance shown in FIG. 1 without problems. As the spectrum changes to that shown in FIG. 2, the afc should maintain resonance in the R0 mode, but the nearby R3 peak might prove more attractive. If the spectrum becomes as shown in FIG. 3, then the afc will inevitably choose the R3 resonance peak.

This explanation of the frequency control is crude and over simplified, but it does serve to explain a phenomenon which has been experienced—certain dies when driven from certain generators have been found to "switch modes" from R0 to R3 under load. Other dies have been tested and the R1 mode found to be close to 20 kHz, so mode switching is again a problem. Ideally these harmonic modes should be excluded from the frequency range 18–22 KHz (±10 per cent) to prevent this problem.

It might be thought that this mode switching should not matter since the die will continue to vibrate. This is not the case because in the R3 mode the radial amplitude on the inside surface of the die is much reduced. Furthermore, there are six "nodal lines" along the inside surface which will experience zero radial amplitude. The friction reducing properties of the die such as is shown in FIG. 1 are therefore, greatly reduced. If a coneless aerosol die made for reducing a can diameter from 45 mm to 31 mm as discussed with reference to FIG. 1, switches to the R3 mode during the necking process, then the can body will be crushed under the suddenly-increased forming load.

The above explains a problem we have experienced in the operation of radial resonant ultrasonic dies. One objective of this invention is to provide a technique for designing ultrasonic dies to prevent the unwanted behaviour. This is done by increasing the separation between the resonant frequencies to ensure that the generator's automatic frequency control keeps the die vibrating in the R0 mode only.

The separation of unwanted resonant frequencies from the R0 mode at 20 kHz can be affected by many factors. Probably the most important are the material properties—Young's Modulus of Elasticity E and density. Most dies have been made from two materials with a hard inner forming die shrink fitting into a fatigue resistant outer so that the whole assembly is resonant at 20 kHz. The materials used for the inner and outer may be dissimilar but for efficient operation both should be chosen to have low acoustic losses (i.e., low energy dissipation within the material caused by the vibrations). This requirement severely limits the choice of materials, particularly for the outer part of the die which (because it is more massive) tends to cause greater energy loss. Five materials have been selected for use in most ultrasonic dies, depending on the design requirements. For the outer part high-strength alloys of titanium or aluminium should be used. For the inner part (where acoustic losses are less important and high hardness is required) there are three materials which have been used with some success—Tool steel (e.g., EN41), Ferro-titanit (Titanium—carbide particles in a powder-metallurgy steel matrix) and a proprietary material called Syalon (modified Silicon nitride ceramic). Selecting materials from these five offers a choice of six combinations, although in practice other design considerations (particularly cost) may rule out some combinations. Finite element analysis can be used to predict frequency separations for each viable combination.

If the preferred combination of materials is shown to have inadequate frequency separation then some change in the separation can be achieved by modifying the cross-section of the die, e.g., the length of the outer part could be increased. (To maintain the R0 frequency at 20 kHz it would probably then be necessary to reduce its outside diameter). This approach is simple and convenient, but in some cases is not very effective. In general this has been found to have a useful effect on the R1 frequency, but little if any effect on the R3.

We have designed "Shaped Ultrasonic Dies" in order to improve the frequency separation in a different way. These dies have been modified to change the basic axisymmetric shape. A convenient way to achieve this is by machining flats on the outside surface (additional to the normal small receptor flat but much larger). The intention is now to change the distribution of mass and stiffness around the die, and hence modify the mode shape and particularly the frequency of one or more harmonic modes.

Note that the system of nomenclature used to characterise the modes of vibration as described in FIG. 3 is strictly no longer valid in respect of these shaped dies. This system is based on the assumption of a sinusoidal variation in amplitude around the die. When the die is round (with only a small transducer flat) this is approximately true. When using a "shaped die", however, the mode shapes are modified and the amplitude variation is no longer strictly sinusoidal. Nevertheless, for relatively small shape changes the modes equivalent to R0, R1 and R3 can still be identified and for convenience the names will not be changed.

Finite element analysis has been used to predict the effect of different flats on the mode shapes and performance of ultrasonic dies. Whilst axi-harmonic elements may be used to study round dies they cannot be used to study these shaped dies which are not even approximately axisymmetric. Two other element types have therefore been used: 2D plane-stress and 3D brick elements.

The number, positions and sizes of flats are crucial to the frequency modifications achievable. After analysis of a large variety of different options certain designs have been identified as most effective for separating resonant frequencies. There are penalties associated with machining away large flats: stresses are increased and the required (R0) modeshape becomes distorted. The effectiveness of any shape could be defined as a measure of how much frequency separation can be achieved before the stress and/or modeshape-distortion becomes unacceptable.

We have discovered that the desired R0 mode of forced vibration of a die can be sustained at about 20 kHz during working by provision of localised mass on concentrations arranged symmetrically about an axial plane normal to the plane of a receptor area that receives the vibration force and that the unwanted modes of vibration can be suppressed.

FIGS. 7(*a*), (*b*) and (*c*) show dies in which the localised mass concentrations have been achieved by machining a plurality of flat surfaces on a round die blank.

In FIG. 7(*a*) the die 25 comprises a top planar surface 26, a bottom Planar surface, a peripheral side surface 27 comprising a pair of parallel flat surface portions 28,29 each subtending an angle of 60° at the die centre, joined at their extremities by a pair of arcuate (unmachined) surfaces 30,31 of the die blank; and an annular work surface defining an aperture extending from the top surface through the die to the bottom surface. A transducer is coupled to the centre of one of the flat surface portions at a receptor area 34.

This arrangement has a resonant frequency in the R1 mode which is lower than that of an equivalent round die (i.e. one with a small receptor flat but without the two parallel flat portions shown in FIG. 7(*a*).

FIG. 7(*b*) shows a modified form of the die of FIG. 7(*a*) in which the receptor area 35 is in the form of a small flat area centred upon a radius of the die bisecting an arcuate surface portion 36 of the die. This receptor area 35 is very small relative to the surrounding surface 36 and its effect on frequency and mode shapes arising is insignificant. This location of the receptor surface 35 increases the frequency of vibration arising in the R1 mode compared to the equivalent round die.

These two designs are effectively identical except for the position of the transducer 33. In reality the effect of using two diametrically opposed flats is to split the R1 mode into two—one aligned with the flats and another aligned with the arcs. The resonant frequencies of these two modes are lowered and raised respectively relative to the original R1 frequency. The positioning of the transducer 33 filters out one or other R1 mode, so that only one R1 mode is found.

We have not yet devised dies for which the R2 frequency is close to 20 kHz (generally this is much lower —approximately 8–12 kHz). However, if increased frequency separation for the R2 mode was required, then a 4 flat design would be effective. Again, the position of the transducer would determine whether the R2 frequency was raised or lowered. While the transducer fitted on a flat the R2 frequency would be lowered. With the transducer fitted on an arc (on a small receptor flat) the R2 frequency would be raised.

Following the same pattern a 6 flat design was considered to increase the separation of the R3 frequency. From FE analysis results, however, this not preferred. This is because the flats must be fairly small —if the die is divided into flats and arcs covering equal angles then each flat would cover only 30°. The angle for the flats can be increased to 60° —producing a hexangonal shape—but this again gives very little frequency separation (the effect of machining 6×60° flats on circular dies is very similar to the effect of simply reducing the outside diameter—both R0 and R3 frequencies are raised.

This is unfortunate, because most problems with harmonic frequencies have been caused by the R3 mode. Also, changes in the cross-section of circular dies (described earlier) are seldom effective in changing the R3 frequency. Therefore, other shapes were tried and a design with three equally spaced flats was found to be useful.

FIG. 7(*c*) shows a "three flat" die 37 comprising a top planar surface 38, a bottom planar surface, and a peripheral wall 39, comprising three chordal flat surface portions 40,41,42, each joined to the next by an arcuate surface portion 43,44,45. Each chordal flat surface subtends an angle of 60° at the central axis of the die. A circular work surface 32 extends from the top surface through the die to the bottom surface to define an aperture. The die shape has 3 lines of symmetry S1,S2, and S3 while the R3 modeshape which we modify has 3 antinodal diameters as shown in FIG. 8(*b*). In contrast, the dies of 7(*a*) and 7(*b*) had 2 lines of symmetry S4,S5, as shown in FIG. 7(*b*) but only one antinodal diameter in the R1 mode as shown in FIG. 4(*b*)1. For this reason the effect of this design on the R3 modeshape and frequency is different. The R3 mode is split into two—one at a higher frequency but the other approximately unchanged. The useful mode (i.e., the one at increased frequency) has the die lines-of-symmetry S1,S2 and S3 aligned with the antinodal diameters shown in FIG. 8(*b*) while the other mode has the lines-of-symmetry S1,S2 and S3 arising between the antinodal diameters. From this it can be seen that if the transducer is fitted in the centre of a flat or in the centre of an arc (on a small receptor flat) it will filter out the unwanted mode and the R3 frequency will be raised.

FIGS. 8(*a*)-8(*e*) permit comparison of the resonant frequencies arising in various shapes of die to which the transducer is fitted in various locations. In FIG. 8(*a*) the transducer is applied to a small receptor surface on a round die. The graph of response v frequency of vibration presented alongside the round die shows an R0 peak at approximately 20.8 kHz; an R1 peak at approximately 21.3 kHz; and an R3 peak at 24.6 kHz. The R1 frequency at 21.3 kHz is close enough to the R0 peak at 20.8 kHz to give risk of switching of mode.

FIG. 8(*b*) shows a transducer applied to a receptor area of an arcuate surface portion of a die having three chordal flat surfaces arranged at an included angle of 60° to each other, each being joined to the next by an arcuate portion. The graph alongside this die shows an R0 peak at 21.1 kHz, an R1 peak at 20.7 kHz and an R3 peak at 25.8 kHz. Comparing this graph to the graph of FIG. 8(*a*) the R3 frequency has been raised significantly, the R0 frequency has been raised slightly and the R1 frequency has been lowered slightly. Therefore, this die shape should be useful for separating the R3 frequency from the R0 frequency but is not particularly appropriate for separating an R1 frequency from an R0 frequency which initially appears slightly below it. Nonetheless, if the frequency response of the die is as shown in FIG. 6(*a*) then this shape would be particularly useful because it raises the R3 frequency to alleviate the problem shown in FIGS. 6(*b*) and 6(*c*).

FIG. 8(*c*) shows a transducer applied to a chordal flat surface of a die having three chordal flat surfaces arranged as shown also in FIG. 9(*b*). The graph alongside shows an R0 peak at 21.3 kHz, an R1 peak at 21.0 kHz and an R3 peak at 25.3 kHz. The R3 peak has a higher response value and is closer to the R3 peak of the round die of FIG. 8(*a*). Therefore this die design arrangement shows no advantage over that of FIG. 8(*b*).

FIG. 8(*d*) shows a transducer applied to a chordal flat surface of a die having two parallel chordal flat surfaces each connected to the other by a pair of arcuate surfaces. The graph alongside shows an R0 peak at 21.0 kHz, an R1 peak at 19.9 kHz, and an R3 peak at 25.1 kHz. Comparing this with the response graph shown in FIG. 9(*a*) the R1 frequency has been lowered significantly while the R0 and R3 frequencies have been raised slightly. This die arrangement achieves useful separation of R1 and R0 frequencies.

FIG. 8(*e*) shows a transducer applied to a receptor area of a surface portion of a die having two chordal flat surfaces arranged parallel to each other and connected by said arcuate surface portion and a second arcuate surface portion. The graph alongside shows an R0 peak at 21.0 kHz, an R1 peak at 23.5 kHz, and an R3 peak at 24.7 kHz. Comparing this graph to that of FIG. 8(*a*) the R1 frequency has been raised significantly while the R0 and R3 frequencies have been raised slightly. Therefore, this arrangement is useful for separating R1 frequency from R0 frequency.

FIGS. 9(*a*) and 9(*b*) are computer printouts showing the R0 and R3 modes of vibration arising in a die having three flat surface portions, each connected to the next by an arcuate surface portion. In FIG. 9(*a*) comparison of the original shape (dashed lines) and displaced shape (hard lines) shows that a useful radial displacement, centred on the axis of the die aperture, is achieved although there is some distortion of the uniform R0 mode.

FIG. 9(*b*) shows that the R3 mode of vibration gives rise to six undesirable nodes in the radial displacement and that the amplitude of vibration at the work surface varies from 50% to 140% of the amplitude at the receptor area.

The selection of transducer position (on flat or arc) for the 3 flat design requires further consideration. As FIG. 9(*b*) shows, and will be discussed later, both the arcs 73,74,75, and the flats 76,77,78, correspond to antinodes A of the required R3 modeshape. However, this modeshape is now distorted so that the amplitude at the antinodes corresponding to flat surface areas 76,77,78, is greater than the amplitude at the antinodes corresponding to the arcs 73,74,75. If the transducer is fitted to a flat then the average amplitude of the die will be less than that for a round die vibrating in a uniform R3 mode because the transducer maintains a constant amplitude at its point of application. Conversely, if the transducer is fitted to an arc then the average amplitude will be greater than for a uniform R3 mode. This is important because the average amplitude determines energy dissipation within the die materials.

If the transducer is fitted to a flat then the power loss will be less than if it is fitted to an arc. This lower power loss implies a sharper resonance peak in the R3 mode which is undesirable. Furthermore, when the effect of a transducer on the resonant frequency is taken into account, it is found to have more influence when fitted to a flat, because it vibrates at relatively higher amplitude. The resonant frequency of the transducer is 20 kHz, so it tends to modify the frequency of the R3 mode towards 20 kHz and reduce the frequency separation. This serves to explain the higher R3 resonance peak and reduced R3 frequency separation shown in the graph of FIG. 8(*c*) compared to FIG. 8(*b*).

The frequency separation achieved using any of the arrangements described is dependent on the size of flats. FIGS. 10(*a*) and 10(*b*) show graphically the variation of R0, R1 and R3 frequencies (as predicted by FEA) with chordal flat sizes (i.e. angle subtended at die centre) for the 3 flat and 2 flat designs shown in FIGS. 8(*b*),8(*d*) and 8(*e*). FIG. 10(*a*) relates to the design of FIG. 8(*b*) whilst FIG. 10(*b*) shows R0, R1 and R3 plots for the designs of FIGS. 8(*d*) and 8(*e*). For best results the flat size should be chosen as small as possible to achieve the required frequency separation without unnecessary distortion of the R0 mode. As the flat size tends to 0° all three designs become equivalent to the round die shown in FIG. 8(*a*).

From FIG. 10(*b*) it is concluded that the larger flat size (above about 40°) on the two flat design causes considerable variation in R1 frequency; and from FIG. 10(*a*) it is concluded that the three flat design requires quite large flats (about 80°) to achieve separation of the R0 and R1 frequencies; and that the three flat design causes considerable separation of R0 and R3 frequencies.

The above description is based on modifying the basic cylindrical shape of a die by machining flats on the outside surface. Many other options are available which would have a similar effect. First the flats and arcs shape is not necessarily the optimum. It would be possible to specify a series of radial co-ordinates and CNC machine the die to an arbitrary shape. The selection of shape then becomes much more complex.

It is possible to modify the mass and stiffness around the die without machining the whole length of the outside surface. Several options are shown in FIGS. 11*a*–11*h*, and many other shapes could also be devised.

FIGS. 11*a*, 11*c*, 11*e* and 11*g* show the plan view and FIGS. 11*b*, 11*d*, 11*f* and 11*h* show the side view of four alternative die shapes, each shape being made by starting with a round die blank which is then machined and tuned.

In FIGS. 11*a* and 11*b* the die 46 has a top flat surface 47, a bottom flat surface 48, both being bounded by three straight sides 49,50,51 at 60° to each other and connected each to the next by an arcuate surface portion 52,53,54. The peripheral side wall of the die comprises three pairs of chordal notches 55 arranged outside a circular annulus 56 which blends into the arcuate surface portions 52,53,54 which act as localised concentrations of mass and stiffness. The aperture in the die is of reducing width.

Figure 11D:
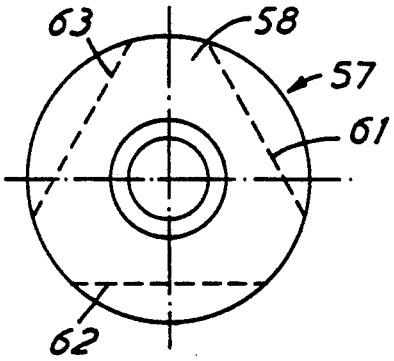
Figure 11C:
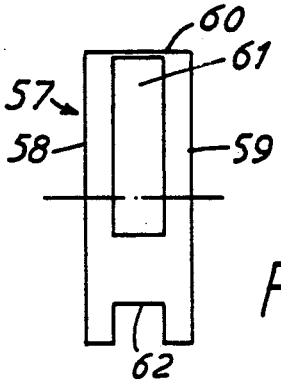

In FIGS. 11*c* and 11*d* the die 57 has a top flat surface 58, a bottom flat surface 59, both being circular. The peripheral cylindrical side wall 60 of this die has three localised chordal flats 61,62,63 cut into it, each flat being smaller than the thickness of the die.

Figure 11F:
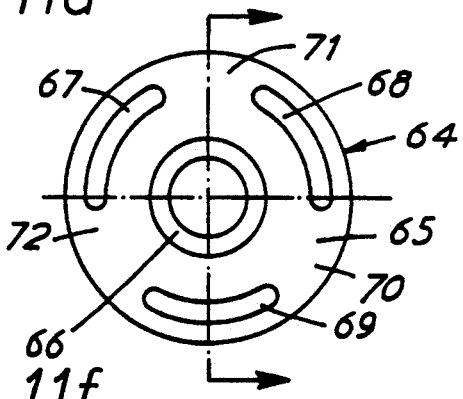
Figure 11E:
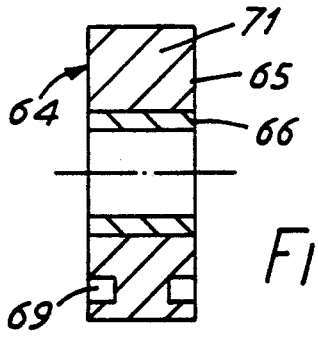

In FIGS. 11*c* and 11*f* the die 64 comprises a cylindrical die holder 65 surrounding a substantially cylindrical die member 66—as could be used for deep drawing of sheet metals or like processes.

Three recesses 67,68,69 are cut into the top face of this die to create localised concentration of mass at each uncut arcuate portion 70,71,72.

Figure 11H:
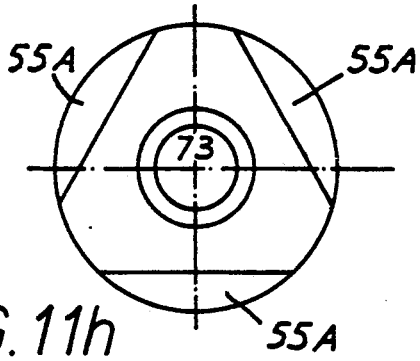
Figure 11G:
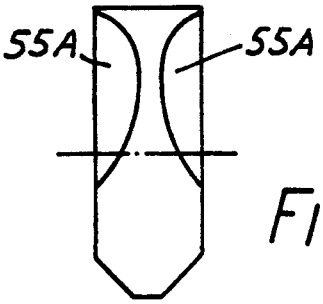

The die of FIGS. 11*g* and 11*h* is similar in principle to the die of FIGS. 11*a* and 11*b* but in FIGS. 11*g* and 11*h* it will be seen that the cut away flats 55A are not parallel to the axis of the die as previously discussed, but are machined at an angle to the axis. This die 55A is depicted as having an aperture 73 of reducing diameter but the angled cuts may be equally well used in dies for other purposes.

The method of designing and constructing dies according to the invention will now be discussed.

A typical procedure for a new die design would be as follows:

(1) Define the inside profile of the die (determined by the process).

(2) Select suitable materials for the die pellet (e.g. Tool steel, "Ferro-titanit", "Syalon"). The choice will depend on required wear-resistance, cost, production time, etc.

(3) Select suitable materials for the die bolster. The choice is normally either aluminium alloy or titanium alloy, depending on required life, abuse-resistance, cost and production time.

(4) Design the die geometry, excluding the outside diameter which must be variable (for tuning the R0 resonant frequency to 20 kHz, or any other required frequency).

(5) Analyse this design using "ANSYS" with 2-D axi-harmonic elements and modal analysis (the most efficient method). Find the R0 frequency and adjust the outside diameter to bring it close to 20 kHz. Repeat the analysis until an outside diameter is found which gives a resonant frequency of 20±0.05 kHz. Then analyse all modes up to the 4th harmonic. This process is automated using suitable computer programs written for this purpose.

(6) Examine all other frequencies near 20 kHz (e.g. in the range 18–22 kHz. If the R1 or R3 frequencies are present than the die must be re-designed. Start by modifying the geometry (repeat from Step 4). If this is unsuccessful re-examine the material selection (repeat from Step 3 or Step 2).

The final result of this design process should be a die with satisfactory resonant frequencies, i.e. a frequency of 20 kHz in the R0 mode and no other radial modes in the range 18–22 kHz. Several designs for coneless aerosol necking dies were produced to this specification. However in some applications constraints on die geometry and materials meant that no satisfactory design could be produced by this method. For this reason the "shaped" dies have been developed to modify the unwanted resonant frequencies.

The models described in FIGS. 4*a*–4*p* are based on a hollow steel cylinder with inside diameter =40 mm, outside diameter=140 mm complete with two flats 180° or with 3 flats 120° apart (all flats with 60° included angle).

The following resonant frequencies for the dies above are in kHz:

| | | | |
|---|---|---|---|
| Complete cylinder | R0 = 20.44 | R1 = 20.96 | R3 = 24.48 |
| 2 flats | R0 = 20.62 | R1 = 19.39/ 23.00 | R3 = 24.66/ 25.16 |
| 3 flats | R0 = 20.68 | R1 = 20.42 | R3 = 24.76/ 25.64 |

The change in frequencies caused by the flats is as follows:

| | |
|---|---|
| 2 flats | R0 + 0,18 |
| | R1 − 1.57 or + 2.04 |
| | R3 + 0.68 or + 0.18 |
| 3 flats | R0 + 0.24 |
| | R1 − 0.54 |
| | R3 + 0.28 or + 1.16 |

The R1 R3 frequencies found in practice will depend on the position of the transducer. The trend of frequency changes is similar for several different types of die tested. This work suggests that certain undesirable frequency behaviour can be corrected by this method. For example:

1) Problem: With R0 frequency at 20 kHz R1 appears at 20.5 kHz, R3 at 22 kHz (1st harmonic too close).

Solution: Use 2-flat design to raise R1 frequency (fit transducer on an arc) by approximately 2 kHz. R0 and R3 almost unaffected.

2) Problem: With R0 frequency at 20 kHz R1 appears 19.5 kHz, R3 at 22 kHz (1st harmonic too close).

Solution: Use 2 flat design to lower R1 frequency (fit transducer on a flat) by approximately 1.6 kHz. R3 frequency is raised to 0.7 kHz while R0 is almost unaffected.

3) Problem: With R0 frequency at 20 kHz R1 appears at 18 kHz, R3 at 21 kHz (3rd harmonic too close).

Solution: Use 3 flat design to raise R3 frequency by approximately 1.2 kHz. R1 is lowered by 0.5 kHz and R0 is almost unaffected.

Problem (3) has appeared quite often, in the design work to date and the 3 flat design has proved very effective in modifying the frequency behaviour of a can die (e.g. the beverage can die shown in FIG. 2).

There are two major disadvantages with the use of shaped (non-axisymmetric) dies. Firstly, not all undesirable frequency behaviour can be corrected using the two options described above. Secondly, there is some distortion of the radial fundamental (R0) modeshape. For a round die the vibration amplitude in the R0 mode is constant around the die. For the shaped dies there is some variation in amplitude—the amplitude in the region of the flats is less than elsewhere as shown in FIG. 9(*a*). This variation is particularly noticeable on the outside surfaces of the die and the amplitude on the inside (working) surface is reasonably constant. The precise amplitude variations require evaluation for each new die design. A compromise will be required between obtaining acceptable frequency performance and a uniform amplitude on the working surface.

Stress Analysis

After designing a die with satisfactory resonent frequencies the stresses must be estimated. Static stresses are induced by the interference fit of the die member in the die holder and alternating stresses are superimposed by the vibrations.

A maximum design amplitude for the die is chosen (say 10 microns) and two stress analyses are conducted—first a static analysis of the interference fit and then a dynamic analysis in the R0 mode (FIGS. 6 and 7).

For a satisfactory design the following conditions must be satisfied.

1) The (compressive) radial stress due to interference at the interface between die member and holder must be greater than the alternating stress due to vibration. This is to ensure that the total radial stress at the interface is always compressive, otherwise the die member will fall out. If the finite element analysis predicts a tensile stress here this will indicate a separation of the surfaces, which must be avoided. This condition effectively places a lower limit on the interference to be used.
2) The alternating stress induced in the die holder by the vibrations must be small enough not to cause fatigue. The superimposed static stress due to interference must also be considered. The greatest danger of fatigue is caused by the hoop stresses in the die holder, which are superimposed on a tensile stress due to interference.
3) Certain die member materials (ceramics and "SYALON" TM) are susceptible to fatigue and fracture under fairly small tensile stress. If these materials are used the interference fit must be sufficient to keep the whole die member in compression when the alternating stresses are superimposed.

In addition to the requirement that separation of the surfaces must not happen it is also important that there should be no slippage of the die member in the die holder. The die holder is usually located axially at one end of the bolster by a small step or flange. The vibrations induce shear stresses across the interface which are resisted by friction. If at any point in the cycle the shear force overcomes the friction force then the die member will slip inside the die holder leading to fretting and burning of the surface and severe energy losses.

Die Manufacture and Tuning

When the frequency and stress analysis work is complete the die is issued for manufacture. The outside diameter of the bolster is made oversize by approximately 5 mm to allow for tolerances on material properties and inaccuracies in the analysis (generally the error in predicted diameter is no more than 2 mm).

The die member and die holder are assembled by shrink fitting. This is used because the interference required is very high—approximately 0.1 mm for a 54 mm diameter. The materials used for the die holder are usually age hardening alloys of titanium or aluminium (for maximum fatigue resistance) which should not be heated above about 200° C. to avoid embrittlement. Therefore, the die member is cooled in liquid nitrogen and the bolster heated to about 200° C. for ease of assembly.

After assembly the resonant frequencies are measured using suitable equipment e.g. Admittance Plotter available from Sonic Systems. The working frequency (R0 mode) is generally at approximately 19.5 kHz. The outside diameter is progressively machined down until this frequency becomes 20±0.05 kHz. For most dies this frequency increases by about 0.1 KHz for each 1 mm reduction in diameter. To ensure that the diameter is not machined too far about half of the expected machining required is done on each operation.

Example: After manufacture a die has a resonant frequency 19.45 kHz.

0.55 kHz increase required—Expect to remove approximately 5.5 mm in total.
Reduce diameter by 3 mm (1st tuning op).
Resonant frequency becomes 19.80 kHz. 0.20 kHz increase required—Expect to remove a further 2.0 mm.
Reduce diameter by 1.0 mm (2nd tuning op).
Resonant frequency becomes 19.93 kHz. 0.07 kHz increase required—Expect to remove a further 0.7 mm.
Reduce diameter by 0.5 mm (3rd tuning op).
Resonant frequency becomes 19.98 kHz.
Tuning complete—the resonant frequency is within tolerance.

After tuning the die is ready for use. The frequency may change slightly with changes in temperature and loading and with die wear, but these changes will be small (about 0.2 kHz typical). If the resonant frequency falls significantly this will probably indicate the growth of a crack in the die.

We claim:

1. A forming die of a kind having a top surface; a bottom surface; a peripheral side surface connecting the bottom surface to the top surface, the distance between the bottom and top surfaces defining the axial thickness of the forming die, and including only a single receptor area for receiving vibratory force; and a continuous annular work surface defining an aperture extending from said top surface through to said bottom surface surrounding a central axis, wherein said peripheral side surface includes at least two convex portions each joined to the next by a substantially flat surface to form a continuous peripheral surface, each of said convex portions defining a localized mass concentration, each of said substantially flat surfaces subtends at the centre of the die an angle of between 40° and 80°, and wherein aid mass concentrations are symmetrically disposed about a plane passing through the single receptor area and coincident with said central axis and are substantially equidistant from and equispaced around said central axis, such that the frequency separation is increased between available resonant frequencies of unwanted modes and the resonant frequency of the chosen $R_o$ mode of vibration, in which, as the aperture expands uniformly and then contracts in a radial direction the die contracts and then expands in axial thickness.

2. A forming die according to claim 1, characterised in that the work surface comprises an annular shoulder forming profile axially aligned with a cylindrical neck forming profile.

3. A forming die according to claim 1, characterised in that the die comprises a die member of a wear resistant tool material surrounded by a die holder having the localised mass concentrations at its periphery.

4. A forming die according to claim 3, characterised in that the die member is made of a tool material chosen from a group consisting of tool steel, titanium carbide in a metal matrix; and a silicon-aluminium-oxygen-nitrogen alloy.

5. A forming die according to claim 3, characterised in that the die holder is made of a metal chosen from a group consisting of aluminium, aluminium alloy, titanium, and titanium alloy.

6. A forming die according to claim 1, characterised in that the peripheral side surface includes a pair of chordal flat surfaces extending parallel to each other and spaced apart by a pair of arcuate surfaces, and the area of each of the chordal flat surfaces is substantially greater than the area of the receptor area.

7. A forming die according to claim 6, wherein the receptor area is located on one of the chordal flat surfaces.

8. A forming die according to claim 6, wherein the receptor area is located on one of the arcuate surfaces.

9. A forming die according to claim 1, characterised in that the peripheral side surface includes three chordal flat surfaces arranged at an included angle of 60° each to the next and each being connected to the next by an arcuate surface portion.

10. A forming die according to claim 9, wherein the receptor area is located centrally on one of the chordal flat surfaces.

11. A forming die according to claim 9, wherein the receptor area is located on one of the arcuate surface portions.

12. A forming die according to claim 6, wherein the chordal flats each subtend an angle greater than about 40° to the die centre.

13. A forming die according to claim 1, characterised in that the receptor area includes a threaded socket to receive a threaded member of a transducer.

14. A forming die according to claim 1, wherein the receptor area subtends a conical angle of 30° at the axis of the aperture.

* * * * *